United States Patent [19]

Bhadra et al.

[11] Patent Number: 4,840,112

[45] Date of Patent: Jun. 20, 1989

[54] COMBINED VALVE/CYLINDER USING ELECTRO-RHEOLOGICAL FLUID

[75] Inventors: Dilip K. Bhadra; Richard L. Creedon, both of San Diego; C. Ross Harder, Rancho Sante Fe, all of Calif.

[73] Assignee: GA Technologies Inc., San Diego, Calif.

[21] Appl. No.: 142,995

[22] Filed: Jan. 12, 1988

[51] Int. Cl.[4] ..... F15B 13/044

[52] U.S. Cl. ..... 91/459; 91/471; 60/326; 137/909; 251/129.21; 73/60

[58] Field of Search ..... 91/275, 165, 47, 51, 91/52, 361, 232, 233, 234, 459, 471; 60/326; 137/909; 73/55, 56, 60; 251/129.21

[56] References Cited

U.S. PATENT DOCUMENTS

| | | | |
|---|---|---|---|
| 2,417,850 | 3/1947 | Winslow | 175/320 |
| 2,661,596 | 12/1953 | Winslow | 60/52 |
| 2,803,968 | 8/1957 | Tilburg | 74/365 |
| 2,820,471 | 1/1958 | Crowell | 137/251 |
| 3,091,164 | 5/1963 | Brandt | 95/54 |
| 3,139,760 | 7/1964 | Pfeifer | 74/44 |
| 3,240,295 | 3/1966 | Martinek et al. | 188/88 |
| 3,274,778 | 9/1966 | Tyrner | 60/326 |
| 3,416,549 | 12/1968 | Chaney et al. | 137/81.5 |
| 3,552,275 | 1/1971 | Chaney et al. | 91/418 |
| 3,599,428 | 8/1971 | Chaney et al. | 60/52 R |
| 3,984,086 | 10/1976 | Gerrish | 366/127 |
| 4,029,158 | 6/1977 | Gerrish | 173/131 |
| 4,316,383 | 2/1982 | Fruman et al. | 73/55 |
| 4,444,298 | 4/1984 | Stangroom | 192/21.5 |
| 4,532,853 | 8/1985 | Stangroom | 91/165 |
| 4,570,478 | 2/1986 | Soong | 73/60 |
| 4,643,024 | 2/1987 | Kovari et al. | 73/151 |
| 4,700,678 | 10/1987 | Elliott | 123/297 |
| 4,744,004 | 6/1988 | Peash | 137/865 |

FOREIGN PATENT DOCUMENTS

| | | | |
|---|---|---|---|
| 1114825 | 9/1984 | U.S.S.R. | 137/909 |
| 848394 | 9/1960 | United Kingdom | 60/326 |

*Primary Examiner*—Robert E. Garrett
*Assistant Examiner*—Thomas Denion
*Attorney, Agent, or Firm*—Fitch, Even, Tabin & Flannery

[57] ABSTRACT

Electrically controlled combined valve/cylinder apparatus. The apparatus includes a housing having a cylindrical body and spaced first and second end walls closing the body. A cylinder is positioned inside the body and a piston is positioned inside the cylinder for reciprocal movement. A control ram connected to the piston extends through an aperture in the first end wall so that the piston is movable between a first position adjacent the first end wall in which the ram is extended and a second postion in which the piston is located adjacent the second end wall so that the ram is retracted. The apparatus further includes a cylindrical control sleeve positioned between and spaced from both the body and the cylinder. An inlet port tube is provided for supplying an electro-rheological fluid to the body while an outlet port tube is provided for discharging the fluid from the body. The control sleeve, the body and the cylinder are each at least partially electrically conductive and together form four electrostatically controlled valves. The actuation of the first and third valve causes the ram to retract and the actuation of the second and fourth valves causes the ram to extend.

7 Claims, 2 Drawing Sheets

COMBINED VALVE/CYLINDER USING ELECTRO-RHEOLOGICAL FLUID

The present invention relates to a cylinder having a piston for controlling movement of a ram and, more specifically, to a valve/cylinder combination using electro-rheological fluid in which the selective application of electrical potential controls movement of the ram.

BACKGROUND OF THE INVENTION

Various types of hydraulic and pneumatic control cylinders have been employed in aircraft for controlling the mechanical positioning of a number of components. Such cylinders typically require the use of separate valves to apply to exhaust the fluid pressure in the volumes of the cylinder behind and in front of the piston to cause movement of the ram or rod. It is always desirable to reduce the space occupied by the control cylinders and their associated valves, as well as to decrease the response time of the cylinder system and increase the mechanical stiffness of the cylinder.

An electro-rheological fluid is a fluid the viscosity of which changes in response to the application of an electrical field. More specifically, such a fluid has the property of becoming substantially rigid upon application of the field having a component normal to the flow direction prior to application of the field. Such fluids and their applications in clutch devices are disclosed in U.S. Pat. Nos. 2,417,850 and 2,661,596 to Winslow. Such a fluid can be a slurry of fine hydrophilic solids in a hydrophobic liquid. The detailed operation of such fluid in a viscous shear clutch is disclosed in U.S. Pat. No. 4,444,298.

A combined valve/cylinder arrangement employing electro-rheological fluid has been proposed. This arrangement uses control sleeves, the energization of which controls liquid viscosity, positioned in longitudinal alignment with the piston. This requires that the housing has a much greater length than the piston travel. This arrangement also requires multiple inlet or outlet ports, or multiple pumps for the fluid. For further information regarding the structure and operation of such a combined valve/cylinder arrangement, reference may be made to U.S. Pat. Nos. 3,416,549; 3,552,275 and 3,599,428.

SUMMARY OF THE INVENTION

Among the several aspects and features of the present invention may be noted the provision of an improved electrically controlled combined cylinder/valve apparatus. The apparatus is of very compact design because the piston is free to travel almost the entire length of the housing. Furthermore, the apparatus has a single control sleeve which is concentric with the housing body and the piston cylinder and forms therewith four distinct valves. This results in the apparatus including only a single inlet port and a single outlet port so that only one pump is needed. The apparatus of the present invention has long service life, is reliable in use, and is relatively easy and economical to manufacture. Other respects and features of the present invention will be, in part, apparent and, in part, pointed out specifically in the following specification and in the accompanying drawings.

Briefly, the apparatus of the present invention includes a housing having a substantially cylindrical body and spaced first and second end walls closing the body.

The body includes a first electrically conductive body portion adjacent the first end wall, a second electrically conductive body portion adjacent the second end wall and an electrically insulative body portion between and conductive portions. The apparatus further includes a cylinder positioned inside the body, with the cylinder similarly having electrically conductive portions spaced by an insulative portion. A piston is located in the cylinder having a control ram connected thereto which extends through an aperture in the first end wall. The piston is movable between a first position adjacent the first end wall in which the ram is extended and a second position in which the piston is adjacent the second end wall so that the ram is retracted. The apparatus further includes a cylindrical, electrically conductive control sleeve positioned between and spaced from both the body and the cylinder, a first port tube extending through the insulative body portion and the sleeve, and a second port tube extending through the insulative body portion and terminating short of the sleeve. The apparatus has a first fluid passageway defined by the sleeve and the second cylinder portion for communicating an electro-rheological fluid between the first tube and the cylinder volume behind the piston. A second tube passageway is defined by the sleeve and the first cylinder portion for communicating the fluid between the first tube and the cylinder volume in front of the piston. A third passageway is formed by the sleeve and the first body portion for communicating the fluid between the second tube and the cylinder volume is front of the piston, while a fourth fluid passageway is formed by the sleeve and the second body portion for communicating the fluid between the second tube and the cylinder volume behind the piston.

BRIEF DESCRIPTION OF THE DRAWINGS

Corresponding reference characters indicate corresponding components throughout the several views of the drawings.

DESCRIPTION OF THE PREFERRED EMBODIMENTS

Figure 1:
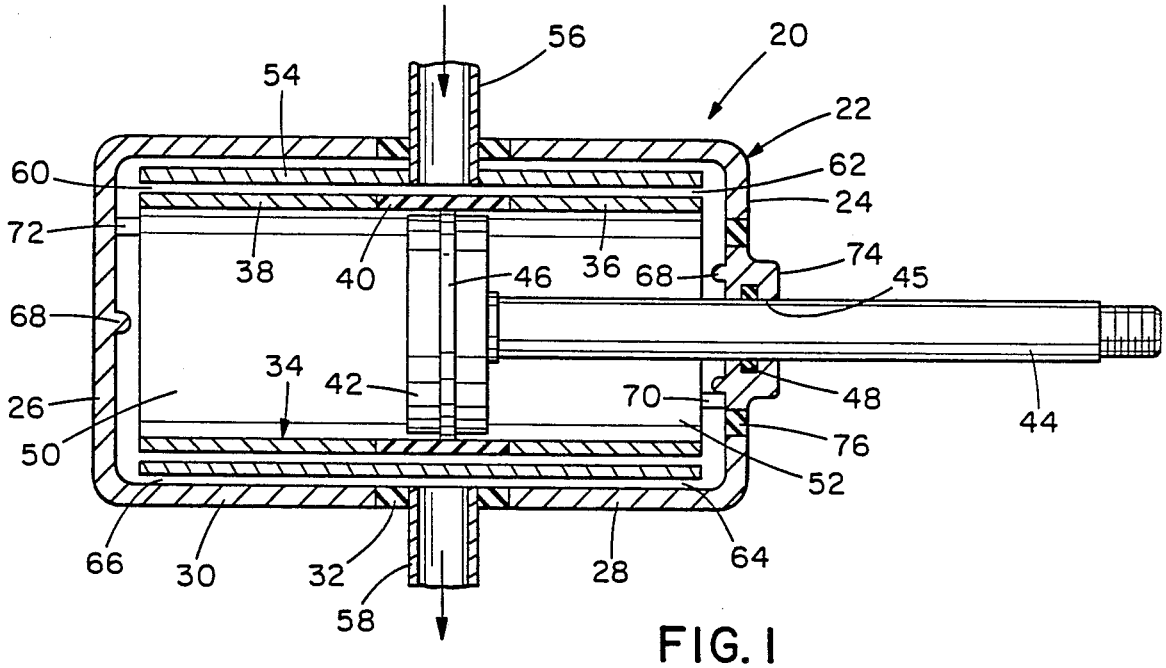
FIG. 1 is a front elevational view, with certain components shown in section, of valve/cylinder apparatus embodying various aspects of the present invention.
Figure 2:
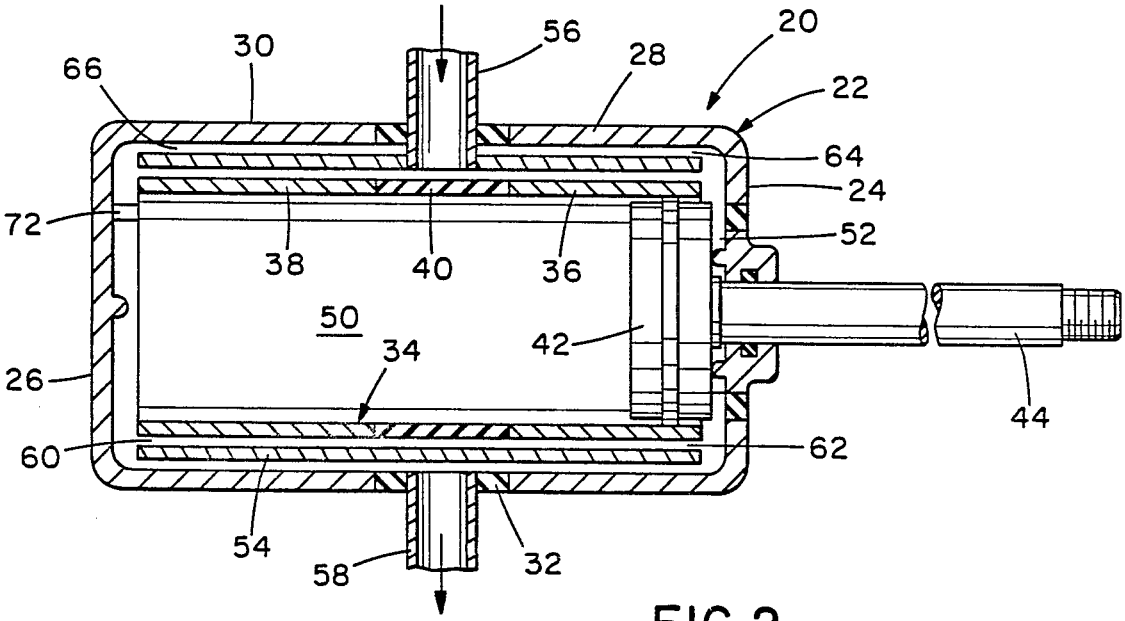
FIG. 2 , similar to FIG. 1, illustrate the valve/cylinder apparatus with the ram in its extended position.
Figure 3:
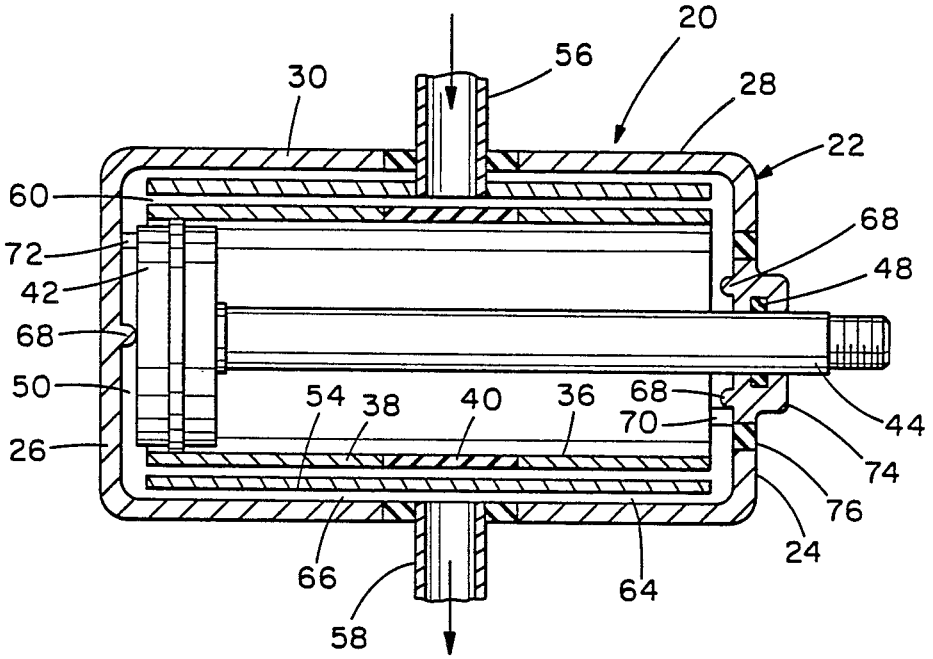
FIG. 3, also similar to FIG. 1, depicts the valve/cylinder apparatus with the ram in its retracted position.

Referring now to the drawings, an electrically controlled combined valve/cylinder apparatus is generally indicated in FIGS. 1–3 by reference numeral 20. The apparatus uses an electro-rheological fluid and forms one control cylinder and four valves, the selective operation of which causes operation of the control cylinder.

More specifically, the apparatus 20 includes a housing 22 including a substantially cylindrical body with spaced first and second end walls 24 and 26, respectively, closing the body. The body is formed by a first electrically conductive body portion 28 joined to the first end wall 24, a second electrically conductive body portion 30 connected to the second end wall 26, and a central electrically insulative body portion 32 joining the conductive portions. A cylinder 34 is held inside the body and is substantially concentric therewith. Similarly, the cylinder 34 is formed by a first electrically conductive cylinder portion 36 disposed adjacent the first end wall 24, a second electrically conductive cylinder portion 38 located near the second end wall 26, and an electrically insulative central cylinder portion 40 joining the conductive portion 36 and 38.

A piston 42, formed of electrically insulative material, is positioned in the cylinder and carries a control ram 44 extending through an aperture 45 in the first wall 24. Suitable seals such as O-rings 46 and 48 are provided for the piston and the ram. The O-ring 46 blocks flow of the fluid past the piston between the cylinder volume 50 behind the piston and the cylinder volume 52 in front the piston, while the O-ring 48 lines the aperture 45 to prevent leakage of the fluid from the housing 22. The piston 42 is movable from a first position adjacent the first end wall 24 (shown in FIG. 2) in which the ram 44 is extended, and a second position (shown in FIG. 3) wherein the piston is located near the second end wall 26 so that the ram is retracted.

Located between the housing body and the cylinder 34 is an electrically conductive control sleeve 54. The sleeve is concentric with the body and the cylinder and is substantially equally spaced from each. An inlet port tube 56, which is preferably electrically conductive, extends through the insulative body portion 32 and the control sleeve 54 for delivering the electro-rheological between the sleeve and the cylinder 34. The tube 56 is connected to a pump (not shown) for providing the fluid under pressure. An outlet port tube 58 functions to discharge the fluid from between housing body and the sleeve. The tube 58 preferably returns the fluid to a reservoir (not shown) from which the pump draws fluid to complete a closed fluid system.

Both the cylinder 34 and the control sleeve 54 either terminate short of the housing end walls 24, 26 or have openings adjacent thereto to permit passage of the fluid to and from the cylinder volumes 50 and 52. The apparatus 20 has a first annular fluid passageway 60 defined by the sleeve 54 and the second cylinder portion 38 for communicating the fluid from inlet tube 56 to the cylinder volume 50 behind the piston, and a second annular fluid passageway 62 defined by the sleeve and the first cylinder portion 36 for supplying the fluid from the inlet tube to the cylinder volume 52 in front of the piston 42. Furthermore, a third annular passageway 64 for communicating the fluid between the cylinder volume 52 and the outlet 58 is defined by the sleeve and the first conductive body portion 28, while the sleeve and the second body portion 30 define a fourth passageway 66 for discharging fluid from cylinder volume 50 to the outlet tube 58.

The end walls 24 and 26 preferably are provided with standoffs 68 for maintaining the piston faces at least slightly spaced from the end walls to permit entrance of the fluid between the piston face and the corresponding end wall. Alternatively, the piston faces could have reliefs or scallops. The apparatus 20 further includes a support for holding the cylinder 34 in position. This support can include insulative tubes 70 and 72 extending from the respective cylinder portions 36 and 38 through the respective end walls 24 and 26 respectively. The first wall 24 includes an electrically conductive central portion 74 defining the aperture 45, and an electrically insulative ring 76 spacing the central portion from the remainder of the first end wall.

Figure 4:
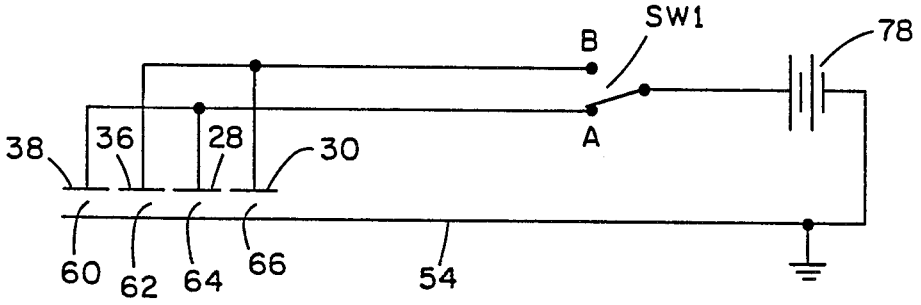
FIG. 4 is an electrical schematic showing an elementary circuit for controlling operation of the apparatus.

Referring to FIG. 4, the valve/cylinder apparatus 20 further includes electrical control circuitry which, in elementary form, includes a voltage source 78, preferably of suitably high voltage DC, having a pair of terminals providing a potential difference. One terminal is connected to the input of a single-pole, double-throw switch SW1, while the other battery terminal, which may be grounded, is connected to the control sleeve 54. The "A" output of the switch is commonly connected to the second cylinder portion 38 and the first body portion 28, while the "B" output of the switch is commonly connected to the first cylinder portion 36 and the second body portion 30. It will be appreciated that the connections to the cylinder portions 36 and 38 can be made through the insulated tubes 70 and 72, respectively. The connections to the body portions 28 and 30 can be made from the out side of the housing 22, while the control sleeve 54 can be grounded through the inlet port tube 56. Accordingly, no moving conductors are required and the conductor placement does not interfere with the movement of the piston 42.

It will be appreciated that the apparatus 20 forms four valves for controlling operation of the movement of the piston. More specifically, the second cylinder portion 38 and the control sleeve 54 form a first valve for controlling flow of the fluid through the first passageway 60. Similarly, the first cylinder portion 36 and the sleeve form a second valve having the passageway 62; the first body portion 28 and the sleeve form a third valve for controlling passageway 64; and the second body portion 30 and the sleeve constitute a fourth valve for selectively blocking fluid flow in passageway 66.

Operation of the valve/cylinder apparatus 20 of the present invention is as follows. Assuming that the position of the piston 42 is initially in a position shown in FIG. 1, connection of the switch SW1 to the voltage source 78 and placement of the switch in its A position causes energization of the second cylinder portion 38 and the first body portion 28. This effectively causes the first and third valves to close because the electro-rheological fluid in annular passageways 60 and 64 has a great increase in viscosity. Accordingly, with the switch in the "A" condition, the fluid enters the inlet pipe 56, flows to the right through passageway 62 into the cylinder volume 52 in front of the piston thereby increasing the pressure. As the fluid passageway 66 has relatively low viscosity fluid, the fluid in cylinder volume 50 is pushed through passageway 66 and out the outlet port tube 58 to the reservoir. Accordingly, the piston 42 moves toward its second position adjacent the second housing end wall 26 causing the ram 44 to retract. Conversely, actuation of the switch SW1 to place it in its "B" position causes energization of the first cylinder portion 36 and the second body portion 30, thereby effectively closing the second and fourth valves. As the second cylinder portion 38 and the first body portion 28 are no longer energized, the passageways 60 and 64 are effectively open. This results in fluid entering the inlet port tube 56, moving to the left in fluid passageway 60, entering the cylinder volume 50 behind the cylinder and causing the fluid in the cylinder volume 52 to be pushed through the outlet port tube 58 via the fluid passageway 64. This causes the piston 42 to be moved towards its first position adjacent the first end wall 24 resulting in extension of the ram 44.

It will be appreciated that the foregoing description of the operation assumes only a very elementary electric control circuit. If a more sophisticated circuit is employed, the apparatus 20 could be controlled (for example, if all four valves could be closed together) to lock the piston in a predetermined position between its fully extended and fully retracted positions. Additionally, if appropriate feedback control is employed and the level of energization of the various valves could be varied, the piston could be stopped in any predetermined position and the speed of movement of the piston between positions could be varied.

The valve/cylinder apparatus 20 has relatively compact size because it integrates the control valve function and the cylinder function within a housing 22 which might only have a diameter of two inches and a length of six inches. The apparatus 20 offers balanced fluid flow as the various passageways are annular to permit the fluid to be substantially uniformly provided to the cylinder volumes behind and in front of the piston. The apparatus also has precise response as relatively small volumes are enclosed and the electro-rheological fluid has a fast characteristic time, that is, the time from which the potential is applied to the time that the viscosity greatly increases, is relatively short.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Electrically controlled combined valve/cylinder apparatus, said apparatus comprising:

a housing including a substantially cylindrical body, and spaced first and second end walls closing said body, said first end wall having an aperture;

a cylinder disposed inside said body, said cylinder and said body being substantially concentric;

a piston disposed in said cylinder;

a control ram connected to said piston and extending through said aperture in said first end wall, said piston being movable between a first position adjacent said first end wall in which said ram is extended and a second position wherein said piston is disposed adjacent said second end wall so that said ram is retracted;

a substantially cylindrical control sleeve disposed between and spaced from both said body and said cylinder;

inlet means for supplying an electro-rheological fluid inside said housing;

outlet means for discharging said fluid from said housing;

said control sleeve, said body and said cylinder each being at least partially electrically conductive and together forming four electrostatically controlled valves, actuation of the first and third valves causing the ram to retract, actuation of the second and fourth valves causing said ram to extend, one of said inlet means and outlet means comprising a first port tube extending through said body and said sleeve, and the other of said inlet means and outlet means comprising a second port tube extending through said body but not said sleeve.

2. Apparatus as set forth in claim 1 wherein said inlet means comprises said first port tube which supplies said fluid between said sleeve and said cylinder, and wherein said outlet means comprising said second port tube which exhausts said fluid from between said sleeve and said body.

3. Apparatus as set forth in claim 2, wherein said first port tube is electrically conductive, said tubes extend from said body at substantially diametrically opposed locations, and said tubes are positioned substantially midway between said first end wall and said second end wall.

4. Electrically controlled combined valve/cylinder apparatus, said apparatus comprising:

a housing including a substantially cylindrical body, and spaced first and second end walls closing said body, said first end wall having an aperture;

a clyinder disposed inside said body, said cylinder and said body being substantially concentric;

a piston disposed in said cylinder;

a control ram connected to said piston and extending through said aperture in said first end wall, said piston being movable between a first position adjacent said first end wall in which said ram is extended and a second position wherein said piston is disposed adjacent said second end wall so that said ram is retracted;

substantially cylindrical control sleeve disposed between and spaced from both said body and said cylinder;

inlet means for supplying an electro-rheological fluid inside said housing;

outlet means for discharging said fluid from said housing;

said control sleeve, said body and said cylinder each being at least partially electrically conductive and together forming four electrostatically controlled valves, actuation of the first and third valves causing the ram to retract, actuation of the second and fourth valves causing said ram to extend, said first wall including an electrically conductive central portion defining said aperture, said first wall further comprising an electrical insulator encompassing said central portion and spacing said central portion from other components of said first wall.

5. An electrically controlled combined valve/cylinder apparatus comprising:

a housing including a substantially cylindrical body, and spaced first and second end walls closing said body, said first end wall defining an aperture, said body including a first electrically conductive body portion disposed adjacent said first end wall, a second electrically conductive body portion disposed adjacent said second end wall and an electrically insulative body portion disposed between said conductive body portions;

a cylinder disposed inside said body, said cylinder and said body being substantially concentric, said cylinder including a first electrically conductive cylinder portion disposed adjacent said first end wall, a second electrically conductive cylinder portion disposed adjacent said second end wall and an electrically insulative cylinder portion disposed between said conductive cylinder portions;

a piston disposed in said cylinder;

a control ram connected to said piston and extending through said aperture in said first end wall, said piston being movable between a first position adjacent said first end wall in which said ram is extended and a second position wherein said piston is disposed adjacent said second end wall so that said ram is retracted;

a substantially cylindrical, electrically conductive control sleeve disposed between and spaced from both said body and said cylinder;

a first part tube extending through said insulative body portion and said sleeve;

a second port tube extending through said insulative body portion and terminating short of said sleeve, said apparatus having a first fluid passageway defined by said sleeve and said second cylinder portion for communicating an electro-rheological fluid between said first tube and the cylinder volume behind said piston, a second fluid passageway defined by said sleeve and said first cylinder portion for communicating said fluid between said first tube and the cylinder volume in front of said piston, a third passageway defined by said sleeve and said first body portion for communicating said fluid between said second tube and the cylinder volume in front and said piston, and a fourth passageway defined by said sleeve and said second body portion for communicating said fluid between said second tube and the cylinder volume behind said piston.

6. Apparatus as set forth in claim 5 further comprising electrical control circuitry including a voltage source having a pair of terminals providing a potential difference, and switch means connected to one terminal of said voltage source, the other terminal of said voltage source being connected to said sleeve, said switch means being switchable between a first condition in which the second cylinder portion and said first body portion are concurrently connected to said one terminal and a second condition in which the first cylinder portion and the second body portion are concurrently connected to said one terminal.

7. Apparatus as set forth in claim 6 wherein said first port tube is an inlet port tube and said second port tube is an outlet port tube, actuation of switch means to said first condition causing the viscosity of said fluid in said first and third passageways to increase whereby said piston moves toward its second position to retract said ram, actuation of said switch means to said second condition causing the viscosity of said fluid in the second and fourth passageways to increase whereby said piston moves towards its first position to extend said ram.

* * * * *

UNITED STATES PATENT AND TRADEMARK OFFICE

CERTIFICATE OF CORRECTION

PATENT NO. : 4,840,112

DATED : June 20, 1989

INVENTOR(S) : Dilip Kumar Bhadra et al.

It is certified that error appears in the above-identified patent and that said Letters Patent is hereby corrected as shown below:

Face of Patent, U.S. References, change the Peash Patent No. from "4,744,004" to --4,749,004--.

Column 1, line 16, change "to" (second occurrence) to --or--.

Column 1, lines 24-25, change "electrical" to --electric--.

Column 1, lines 61-62, change "respects" to --aspects--.

Column 2, line 4, change "and" (second occurrence) to --the--.

Column 2, line 25, change "tube" to --fluid--.

Column 2, line 30, change "is" to --in--.

Column 2, line 40, change "illustrate" to --illustrates--.

Column 4, line 15, change "out side" to --outside--.

Column 5, line 68, change "comprising" to --comprises--.

UNITED STATES PATENT AND TRADEMARK OFFICE

CERTIFICATE OF CORRECTION

PATENT NO. : 4,840,112

DATED : June 20, 1989

INVENTOR(S) : Dilip Kumar Bhadra et al.

It is certified that error appears in the above-identified patent and that said Letters Patent is hereby corrected as shown below:

Column 6, line 24, before "substantially" insert --a--.

Column 7, line 4, change "part" to --port--.

Signed and Sealed this

Seventeenth Day of April, 1990

*Attest:*

*Attesting Officer*

HARRY F. MANBECK, JR.

*Commissioner of Patents and Trademarks*